US005628406A

United States Patent [19]

Yoshida et al.

[11] Patent Number: 5,628,406

[45] Date of Patent: May 13, 1997

[54] SEPARATING APPARATUS AND IMAGE FORMING APPARATUS

[75] Inventors: Yasumi Yoshida, Yokohama; Masanari Shirai, Chigasaki; Makoto Tanaka, Tokyo; Takeshi Aoyama, Yokohama, all of Japan

[73] Assignee: Canon Kabushiki Kaisha, Tokyo, Japan

[21] Appl. No.: 355,687

[22] Filed: Dec. 14, 1994

[30] Foreign Application Priority Data

Dec. 17, 1993 [JP] Japan ..... 5-343263
Dec. 5, 1994 [JP] Japan ..... 6-300938

[51] Int. Cl.[6] ..... B03C 1/30; G03G 21/00

[52] U.S. Cl. ..... 209/38; 399/358; 399/29

[58] Field of Search ..... 209/38, 219, 213, 209/225, 226, 227, 215; 355/215, 245, 298; 118/652

[56] References Cited

U.S. PATENT DOCUMENTS 1,619,732 3/1927 Jaxon ..... 209/258 X
4,389,968 6/1983 Satomura ..... 118/652
4,595,277 6/1986 Maczuszenko et al. ..... 355/245 X
5,019,870 5/1991 Bares ..... 355/298
5,260,760 11/1993 Takemura et al. ..... 355/245 X
5,455,666 10/1995 Saito et al. ..... 118/652 X

FOREIGN PATENT DOCUMENTS 211913 3/1990 Japan .

*Primary Examiner*—William E. Terrell
*Assistant Examiner*—Tuan Nguyen
*Attorney, Agent, or Firm*—Fitzpatrick, Cella, Harper & Scinto

[57] ABSTRACT

A separating apparatus for separating foreign matter from magnetic toner, includes a filter with openings allowing a toner to pass therethrough, a vibration generator for vibrating the filter in a substantially horizontal direction relative to a filter surface of the filter, and magnetic field generator for generating a magnetic field for attracting the magnetic toner through the filter.

44 Claims, 8 Drawing Sheets

SEPARATING APPARATUS AND IMAGE FORMING APPARATUS

BACKGROUND OF THE INVENTION

1. Field of the Invention

The present invention relates to a separating apparatus for separating impurity from powder developer (referred to as "toner" hereinafter) in order to reuse the used toner for image formation used with an image forming apparatus such as an electrophotographic copying machine, an electrophotographic printer and the like for forming an image on a recording medium by using the toner, and an image forming apparatus utilizing such a separating apparatus.

2. Related Background

In conventional image forming apparatuses of this kind, it is common to collect toner removed from an electrophotographic photosensitive member by a cleaner after a toner image was formed on a recording medium. However, an image forming apparatus has been proposed wherein the collected toner is returned to a developing means for use in the image formation to achieve effective use of the toner.

By the way, the toner collected in the cleaner includes various foreign matter such as paper powder generated from the recording medium, dust, aggregated toner particles and the like mixed with the toner. If the collected toner is returned to the developing means as it is, it is impossible to obtain a good image.

To eliminate such a problem, regarding magnetic toner, involves taking advantage of the fact that the foreign matter mixed with the toner is substantially non-magnetic. That is to say, by generating a magnetic field in the vicinity of a mesh filter, the toner is forcibly passed through the filter, so that the foreign matter which was not passed through the filter is separated from the toner and then is collected (refer to, for example, Japanese Patent Publication No. 2-11913 filed on Oct. 30, 1980 and published on Mar. 16, 1990).

On the other hand, the inventors have proposed a technique in which magnetic field generating members are arranged above and below a mesh filter and the collected toner is supplied from a cleaner to a lower magnetic field so that, after the toner is absorbed to the lower magnetic field generating member, the toner alone is forcibly transferred to an upper stronger magnetic field through the mesh filter, thereby separating the foreign matter from the toner, which separated foreign matter is in turn collected (refer to U.S. Ser. Nos. 188,838, 188,883, 266,496 and 266,452).

According to the inventions described in the above U.S. Patent Application Specifications, when magnetic toner is used as toner, the foreign matters can be removed from the magnetic toner effectively, and, even when the magnetic toner, used once in the image formation, is used again in other image formation, a good image can be obtained.

The present invention relates to further improvement in the aforementioned inventions.

SUMMARY OF THE INVENTION

An object of the present invention is to provide a separating apparatus for re-generating magnetic toner which can be used in image formation, and an image forming apparatus utilizing such a separating apparatus.

Another object of the present invention is to provide a separating apparatus, which can effectively remove foreign matter from magnetic toner, wherein, even when the magnetic toner, used once in image formation, is used again for other image formation, a good image can be obtained, and to provide an image forming apparatus utilizing such a separating apparatus.

The other object of the present invention is to provide a separating apparatus and an image forming apparatus wherein foreign matter can be separated from the used toner stably and effectively for a long time with less noise and less wear of parts than is typical of the prior art.

DETAILED DESCRIPTION OF THE PREFERRED EMBODIMENTS

Figure 13:
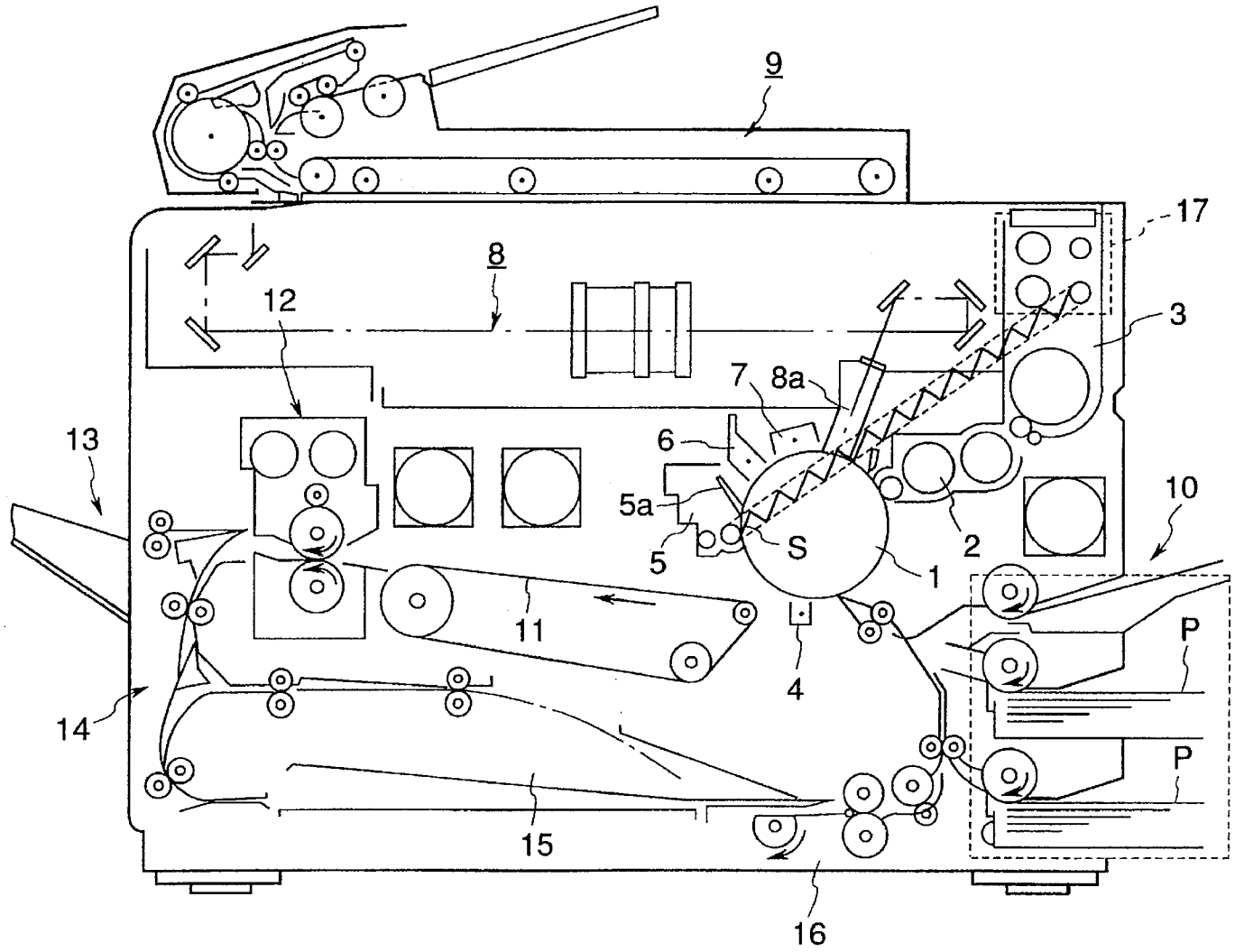
FIG. 13 is an elevational sectional view of an image forming apparatus to which the separating apparatus of the present invention can be applied.

First, an embodiment of an image forming apparatus having a separating apparatus of the present invention will be explained with reference to the accompanying drawings. FIG. 13 is a schematic elevational sectional view of an electrophotographic copying machine as an image forming apparatus.

In FIG. 13, the image forming apparatus, i.e., a copying machine comprises an image bearing member (for example, an electrophotographic photosensitive drum) 1, a developing device 2 adapted to visualize a latent image formed on the image bearing member 1 (i.e., develop the latent image) with developer and having a hopper portion 3 for supplying the developer (one-component magnetic toner in the illustrated embodiment), a transfer means 4 for transferring a toner image visualized on the image bearing member 1 onto a sheet (recording medium), a cleaning device 5 for removing the residual toner and other foreign matter remaining on the image bearing member 1, an electricity removal means 6 for removing residual charge remaining on the image bearing member 1, a first charger 7 for uniformly charging the image bearing member 1, an optical reading system 8 for reading image information on an original, and an exposure portion 8*a* for exposing the image information on the image bearing member 1 to form the latent image. An original treating device 9 for directing the original to an image reading portion, and a sheet supply portion 10 for supplying the sheet P to an image forming portion are associated with the image forming apparatus.

The image forming apparatus further comprises a convey means 11 for conveying the sheet P, a fixing device 12 for fixing the image (toner image) transferred to the sheet at the image forming portion to the sheet P, a sheet discharge portion 13 for discharging the sheet on which the image was formed, a re-supply sheet treatment portion 14 for directing the sheet to be re-supplied in a both-face recording mode or a multi-recording mode to the image forming portion again, an intermediate tray 15 for temporarily storing the sheets to be re-supplied, and a sheet re-supplying portion 16 for supplying the sheet stored on the intermediate tray 15 to the image forming portion again.

Next, an operation of the image forming apparatus will be explained. When a copy start button (not shown) is depressed, the original in the original treating device 9 is directed to the original reading portion, where the image information on the original is read by the optical reading system 8.

On the other hand, the image bearing member 1 from which electricity was previously removed by the electricity removal means 6 is charged to a predetermined potential by the first charger 7, and then, at the exposure portion 8*a*, the image information is written on the image bearing member as a latent image. The latent image formed on the image bearing member 1 is visualized with magnetic toner by the developing device 2 as a toner image. When the magnetic toner in the developing device 2 is decreased, new magnetic toner is replenished to the developing device from the hopper portion 3. When the sheet P is sent to a transfer station of the image forming portion from the sheet supply portion 10, the toner image formed on the image bearing member 1 is transferred onto the sheet P by the transfer means 4. After the transferring operation, the sheet P is sent to the fixing device 12, where the toner image is fixed to the sheet P.

After the fixing operation, in a one-face copy mode, the sheet P is discharged to the discharge portion 13. On the other hand, in a both-face copy mode or a multi-copy mode, the sheet is not discharged to the discharge portion, but is sent to the re-supply sheet treatment portion 14 where at which the sheet is then stored on the intermediate tray 15. When a predetermined number of sheets are stacked on the intermediate tray, the sheets are separated one by one by means of the re-supplying portion 16, and the separated sheet is re-supplied to the transfer station of the image forming portion. When a next original is sent to the image reading portion by the original treating device 9, the above mentioned image forming operations are repeated, thereby forming the toner image on the other surface of the sheet. Then, the sheet is discharged to the discharge portion 13.

After the transferring operation, the toner (which was not transferred from the image bearing member 1 to the sheet P) and paper powder, dust and the like (referred to as "foreign matter" hereinafter) remaining on the image bearing member are removed by the cleaning device 5 (In the illustrated embodiment, the toner and the foreign matter remaining on the image bearing member 1 are removed by an elastic cleaning blade 5*a*). The removed toner and foreign matter are sent, by a screw S, to a separating apparatus 17 which will be described later.

Figure 1:
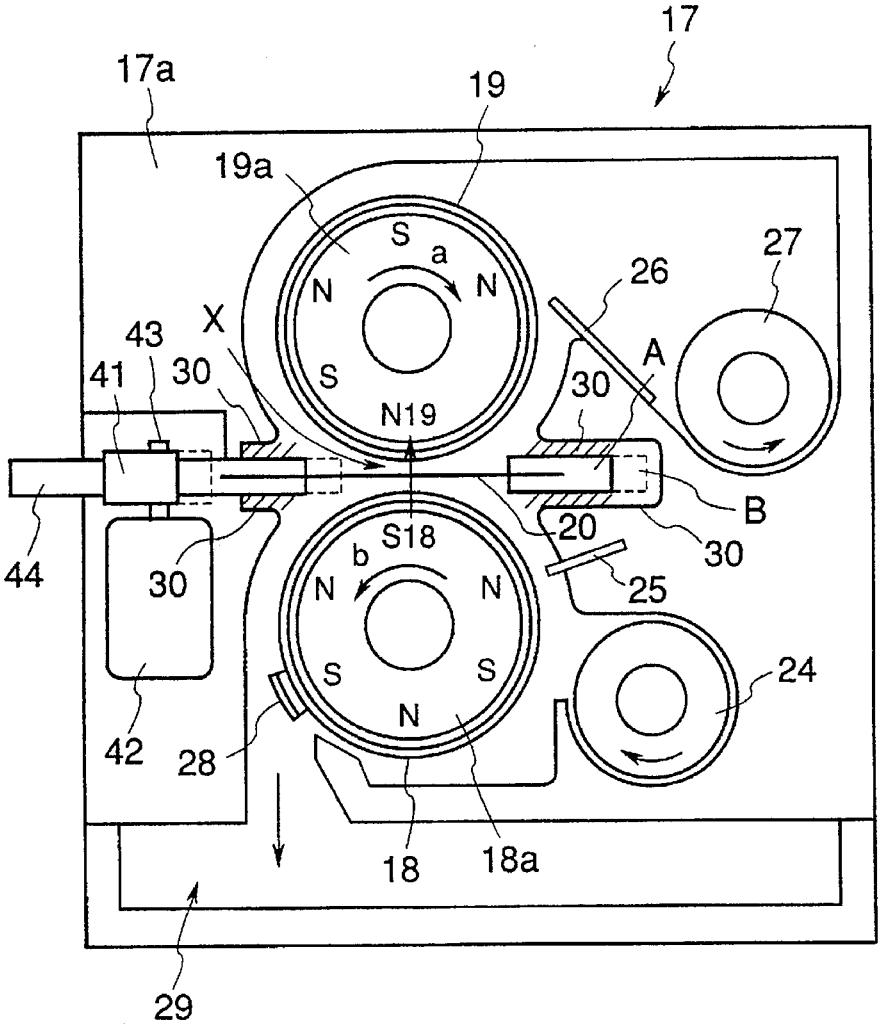
FIG. 1 is an elevational sectional view of a separating apparatus according to an embodiment of the present invention.
Figure 2:
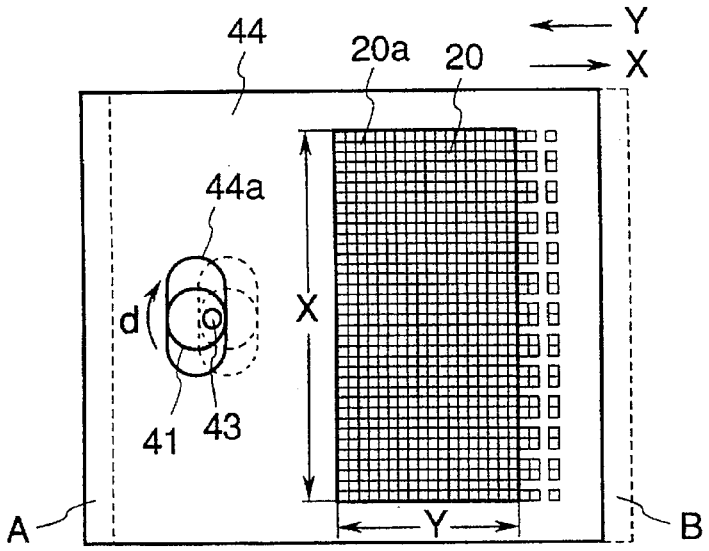
FIG. 2 is a plan view of a mesh filter and a drive mechanism therefor of the separating apparatus of FIG. 1.
Figure 3:
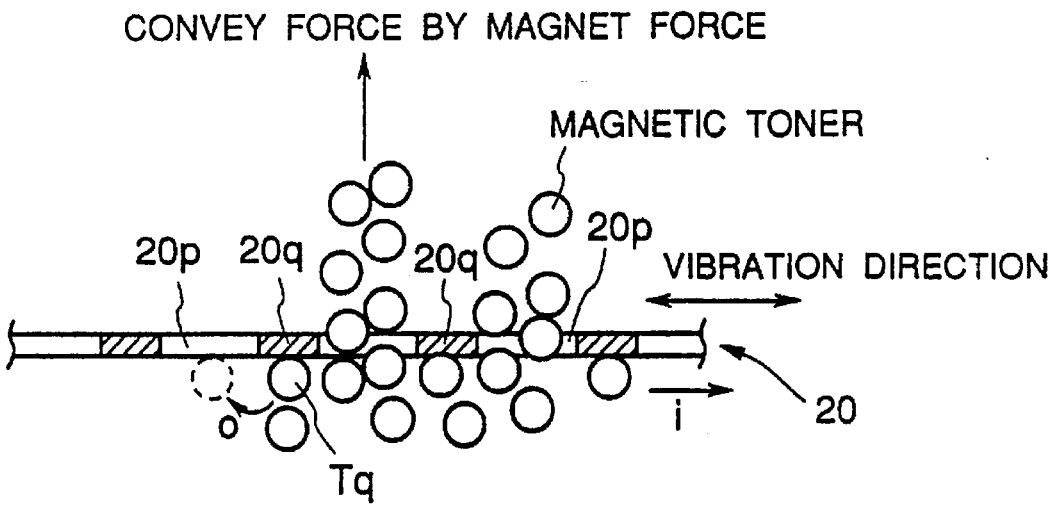
FIG. 3 is an explanatory view for explaining an operation of the mesh filter.
Figure 4:
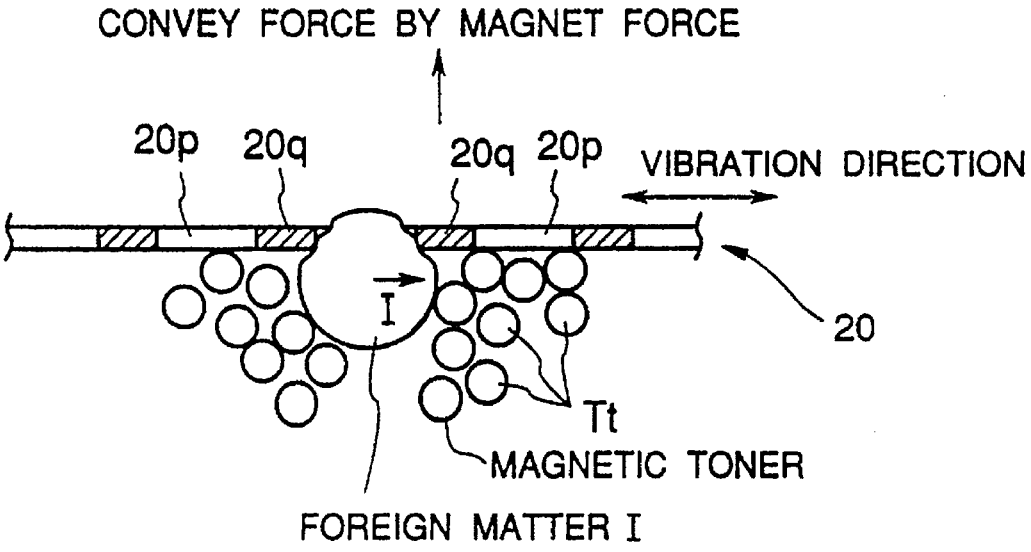
FIG. 4 is an explanatory view for explaining the operation of the mesh filter in relation to a large diameter foreign matter.
Figure 5:
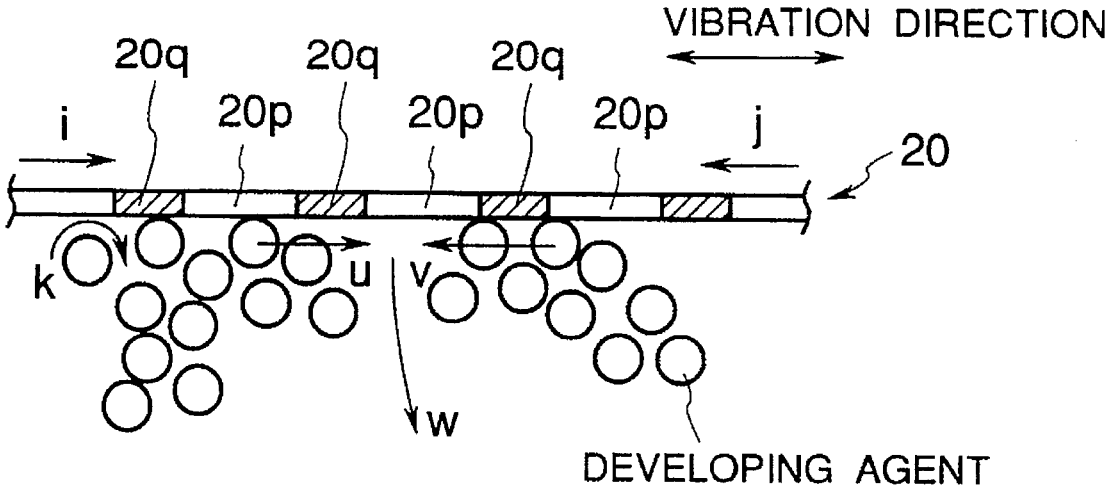
FIG. 5 is an explanatory view for explaining how the mesh filter acts on toner particles.

Next, the separating apparatus according to a first embodiment of the present invention will be explained with reference to the accompanying drawings. FIG. 1 is an elevational sectional view of the separating apparatus according to the embodiment of the present invention. FIG. 2 is a plan view of a mesh filter and a drive mechanism therefor of the separating apparatus of FIG. 1. FIG. 3 is an explanatory view for explaining an operation of the mesh filter. FIG. 4 is an explanatory view for explaining the operation of the mesh filter when a large diameter foreign matter. FIG. 5 is an explanatory view for explaining how the mesh filter acts on toner particles.

In FIGS. 1 to 5, the separating apparatus 17 has a frame 17*a* within which a mesh filter 20 made of non-magnetic material (for example, non-magnetic stainless steel wires, non-magnetic brass wires, nylon fibers or the like) is arranged along a direction substantially perpendicular to a gravity acting direction (i.e., at an inclination angle of 0° with respect to a horizontal plane). Sleeves 18, 19 (for example, made of aluminum) incorporating respective magnet rollers 18*a*, 19*a* are disposed above and below the mesh filter 20. Incidentally, as shown in FIG. 1, each magnet roller 18*a*, 19*a* has N poles and S poles alternately arranged. In a condition that magnetic poles $S_{18}$ and $N_{19}$ of the magnet rollers 18*a*, 19*a* are opposed to each other as shown in FIG. 1, the sleeves 18, 19 are rotated in directions shown by arrows a, b in FIG. 1. That is to say, the sleeves 18, 19 are rotated in opposite directions. By the rotation of the sleeve 18, the residual matter adhered to a surface of the sleeve 18 is shifted in the same direction as the rotational direction of the sleeve 18. On the other hand, by the rotation of the sleeve 19, the magnetic toner adhered to a surface of the sleeve 19 is shifted in the same direction as the rotational direction of the sleeve 19.

Incidentally, a relation between magnetic forces of the magnetic poles $S_{18}$, $N_{19}$ at a separating zone X where the sleeves 18, 19 are opposed to each other with the interposition of the mesh filter 20 by which the foreign matter is separated from the magnetic toner is $N_{19}>S_{18}$.

Further, a convey screw 24 for conveying the residual matter serves to convey the magnetic toner and the foreign matter collected in the cleaning device 5 to the separating apparatus 17, and a convey screw 27 for conveying the toner serves to convey the magnetic toner (from which the foreign matter was removed) to the hopper portion 3 of the developing device 2. A doctor blade 25 serves to regulate a thickness of a layer of the residual matter adhered to the sleeve 18, and a scraper blade 26 serves to scrape the magnetic toner adhered to the sleeve 19 and to guide the scraped toner to the convey screw 27. A non-magnetic abutment member 28 serves to scrape the residual matter (non-magnetic matter) remaining on the sleeve 18 into a collecting portion 29, and a seal member 30 serves to prevent the powder such as toner from leaking from the separating apparatus 17.

Next, a separating operation of the separating apparatus 17 for separating the foreign matter from the magnetic toner will be explained. First, the mixture of the magnetic toner and the foreign matter removed from the image bearing member 1 by the cleaning device 5 is supplied to the proximity of the sleeve 18 in the separating apparatus 17 by means of the convey screw 24. Then, the mixture is adhered to the surface of the sleeve 18 to be conveyed upwardly by the rotation of the sleeve 18. That is to say, the mixture is sent to the separating zone X. Although foreign matter such as paper powder is non-magnetic, since it is mixed with the magnetic toner when the residual matter is removed from the image bearing member, the foreign matter adheres to the surface of the sleeve 18 together with the magnetic toner. A thickness of a layer of the mixture of the magnetic toner and the foreign matter adhered to the sleeve 18 is regulated by the doctor blade 25, and the mixture is sent to the separating zone X where the sleeves 18, 19 are opposed to each other.

As mentioned above, the relation between the magnetic poles $S_{18}$ and $N_{19}$ at the separating zone X is $N_{19}>S_{18}$. Thus, the mixture sent to the separating zone X by the sleeve 18 is moving from the surface of the sleeve 18 toward the surface of the sleeve 19 under the action of magnetic fields formed by the magnet rollers 18*a*, 19*a*. In this case, since there is the mesh filter 20 between the sleeves 18, 19, only the magnetic toner having small particle diameter can pass through the mesh of the mesh filter 20, and the foreign matter such as paper powders each having particle diameter remarkably greater than that of the magnetic toner cannot pass through the mesh filter 20.

Since the mesh of the mesh filter 20 (preferably, 150 μm (#100) to 37.5 μm (#400)) has an opening several times greater than the particle diameter of the magnetic toner (average particle diameter of 5 to 20 μm) as shown in FIG. 4, the magnetic toner can pass smoothly through the mesh of the filter.

On the other hand, since the magnetic toner adhered to the foreign matter is moving toward the surface of the sleeve 19, an amount of the magnetic toner on the foreign matter is greatly decreased, with the result that a force for moving the foreign matter in opposition to the gravity force is greatly reduced, thereby dropping the foreign matter onto the surface of the sleeve 18 by its own weight.

Further, in the illustrated embodiment, even if the foreign matter is caught by the mesh of the filter 20, since the filter 20 is vibrated along a direction substantially parallel to a surface 20*a* of the filter by an eccentric cam 41 connected to a drive motor 42, the foreign matter caught by the filter 20 can be dropped by the vibration.

Next, a mechanism for applying the vibration to the filter 20 along the substantially horizontal direction will be explained.

The mesh filter 20 is supported by a support member 44 which is slidable in a horizontal direction with respect to the frame 17*a*, and a slot 44*a* is formed in the support member 44. The eccentric cam 41 secured to a rotary shaft 43 of the drive motor 42 attached to the frame 17*a* is rotatably fitted into the slot 44*a*. Thus, the vibration is applied to the support member 44 by the eccentric cam 41 rotated by the drive motor 42, with the result that the vibration is transmitted to the filter 20 supported by the support member 44 along the horizontal direction substantially parallel to the surface 20*a* of the filter 20. That is to say, by driving the drive motor 42, the support member 44 and accordingly the mesh filter 20 are reciprocally shifted in directions shown by the arrows X, Y in FIG. 2 along the horizontal direction. As a result, the support member 44 and accordingly the mesh filter 20 are vibrated between the solid line position and the broken line position along a plane parallel to a plane of FIG. 2.

With this arrangement, it is possible to effectively separate the foreign matter from the used toner and to reduce noise generated by vibrating the mesh filter. Now, such advantages will be explained.

FIG. 3 is a view for explaining movement of toner when the mesh filter is vibrated in the horizontal direction (left-and-right direction in FIG. 3). In FIG. 3, the mesh filter 20 includes a mesh portion (openings) 20*p* and a solid portion 20*q*. The toner is shifted from below to above. When the filter 20 is shifted toward a direction shown by the arrow i, the toner particle Tq which was abutted against the solid portion 20*q* of the filter 20 to be prevented from passing through the filter is relatively shifted toward a direction shown by the arrow o, thereby aligning the toner particle with the opening 20*p*. As a result, the toner particle Tq can pass through the filter 20 by the magnetic force.

On the other hand, as shown in FIG. 4, if a large diameter foreign matter I is caught between the solid portions 20*q*, when the filter 20 is shifted to the direction i, this foreign matter I is also shifted to the same direction. In this case, since the foreign matter I is subjected to resistance forces of the toner particles Tt exsisting to the right of the foreign matter, the foreign matter I is separated from the solid portions 20*q* of the filter 20 by such resistance forces, thereby facilitating the separation of the foreign matter from the magnetic toner.

The movement of the toner will be further explained with reference to FIG. 5. First, considering one toner particle, when the filter 20 is shifted to the direction i, the toner particle is rotated by a torque shown by the arrow k. As a result, this toner particle has difficulty aggregating with other toner particles. Further, considering a group of toner particles, when the filter 20 is shifted in the direction i, the group of toner particles adhered to the filter is shifted in a direction shown by the arrow u, and, when the filter 20 is shifted in a direction shown by the arrow j, the group of toner particles adhered to the filter is shifted in a direction shown by the arrow v.

In this way, since the group of the toner particles is vibrated normally and reversely by the horizontal vibrational movement of the filter 20, the toner particles can be agitated to facilitate the separation between the toner particles. Further, when the group of the toner particles is divided into small sizes to the extent of the single toner particle, the toner particles can be conveyed upwardly under the action of the magnetic field acting on the toner particles, and, since the toner particles are struck against each other during the vibration when they are shifted, for example, in a direction shown by the arrow w, the aggregation between the toner particles can be prevented, thereby finely separating the toner particles from each other, thus improving the toner conveying ability.

Further, by vibrating the filter 20 along substantially the horizontal direction (direction substantially perpendicular to the magnetic field acting direction), since the alignment of the toner particles with the openings 20*p* of the filter 20 is greatly increased, the frequency of vibration can be reduced. According to experiment, it was found that the vibration having the frequency of about 4 to 40 Hz (and amplitude of about 1 to 5 mm) along the horizontal direction is sufficient.

Figure 6:
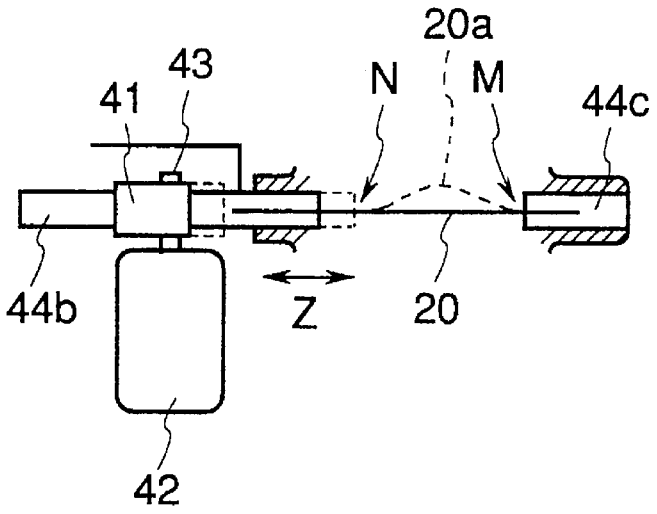
FIG. 6 is a side view of a main portion of a separating apparatus according to a second embodiment of the present invention.
Figure 7:
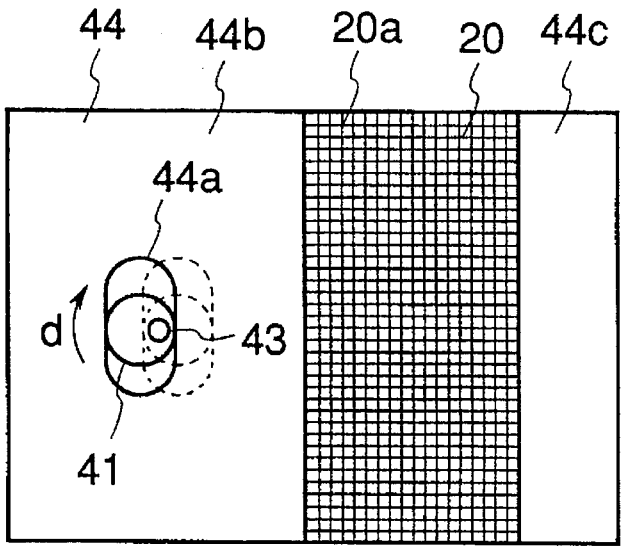
FIG. 7 is a plan view of a mesh filter and a drive mechanism therefor of the separating apparatus of FIG. 6.

In the aforementioned embodiment, while an example in which the filter 20 is vibrated along the horizontal direction was explained, the filter may be vibrated by another method without impact. FIGS. 6 and 7 show another embodiment. The same functional and structural elements as those of the first embodiment are designated by the same reference numerals and detailed explanation thereof will be omitted.

In FIGS. 6 and 7, the support member 44 for supporting the mesh filter 20 is divided into a first support portion 44*b* having the slot 44*a* into which the eccentric cam 41 is rotatably fitted, and a second support portion 44*c* secured to the frame 17*a*. As is in the first embodiment, the first support portion 44*b* is vibrated along the horizontal direction by the cam 41. However, since the second support portion 44*c* is secured to the frame 17*a*, the filter 20 cannot be shifted or vibrated. To the contrary, since a portion N of the filter near the movable support portion 44*b* is reciprocally shifted in directions shown by the arrow Z with respect to a portion M of the filter near the stationary support portion 44*c*, the filter is flexed as shown by 20*a* (broken line) when the support portion 44*b* is shifted to the right, and the filter is returned to the straight condition when the support portion 44*b* is shifted to the left, thereby repeating the flexed condition and the straight condition of the filter alternately.

In this way, although the filter 20 is driven in the horizontal direction, it is vibrated along the vertical direction to separate the toner from the filter. That is to say, since the mesh filter 20 is provided between the movable support portion 44*b* and the stationary support portion 44*c*, under the action of the movable support portion 44*b*, as shown by the solid line and the broken line in FIG. 6, the flexed condition and the straight condition of the filter are repeated alternately. As a result, since the filter 20 is vibrated in the horizontal direction and the vertical direction and the filter itself is deformed during the vibration, the large diameter foreign matter clogged in the opening of the filter can be removed easily and effectively from the filter. Incidentally, in this embodiment, it is preferable that the support portions 44*b*, 44*c* are formed from resilient metal plates or plastic plates.

Figure 8:
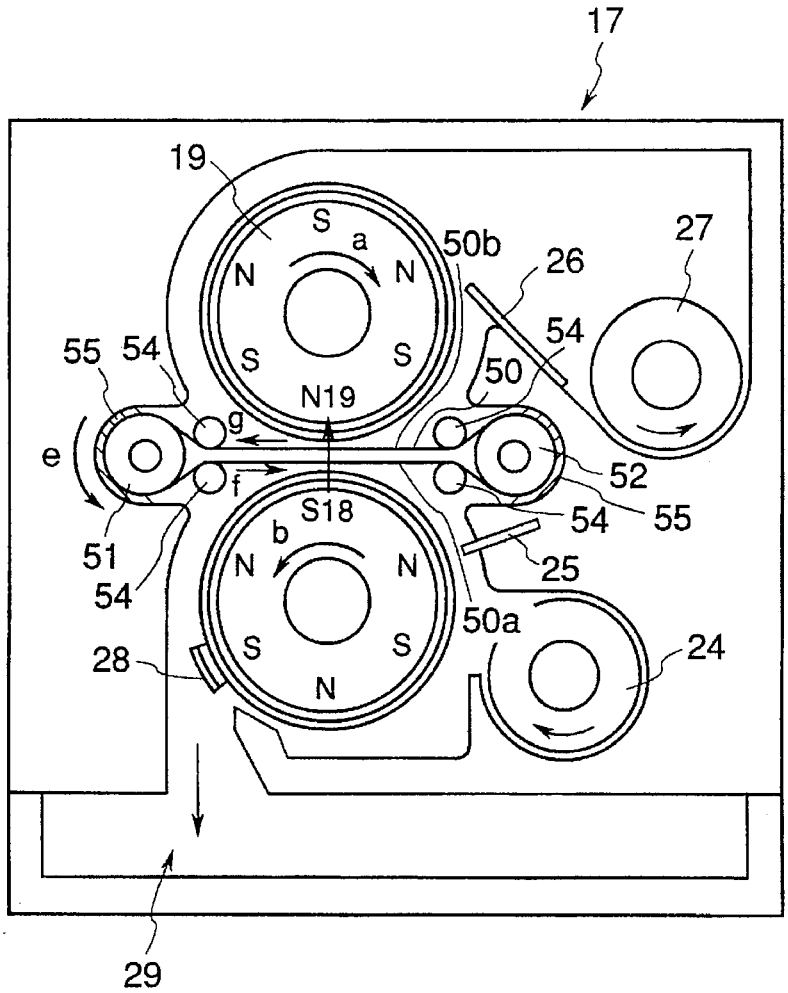
FIG. 8 is an elevational sectional view of a separating apparatus according to a third embodiment of the present invention.
Figure 9:
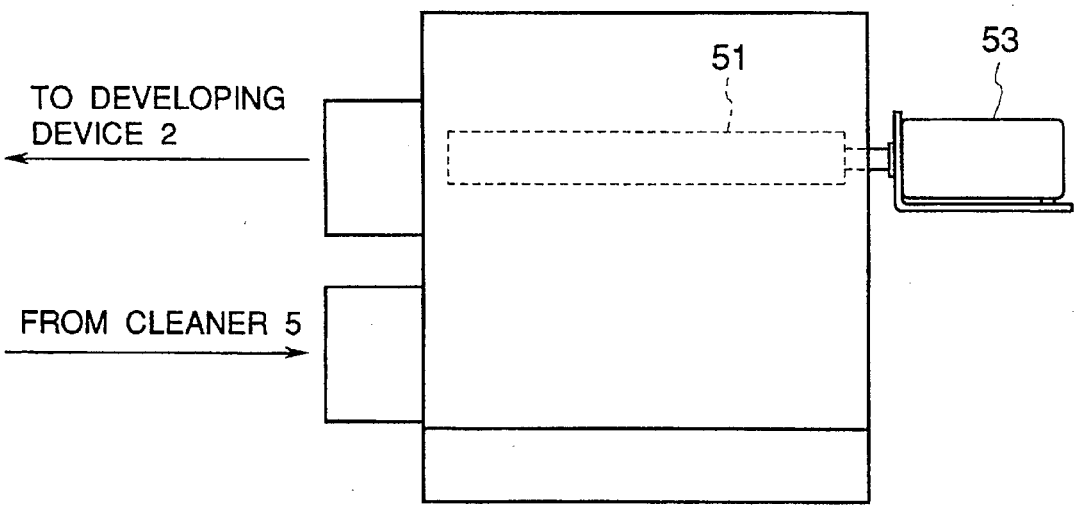
FIG. 9 is a side view of the separating apparatus of FIG. 8.

In the aforementioned embodiments, while an example in which the filter is reciprocally shifted by the rotation of the cam 41 was explained, the filter may be continuously shifted in one direction. Also in this case, the same advantage as those of the first and second embodiments can be achieved. FIGS. 8 and 9 show a third embodiment of the present invention. The same functional and structural elements as those of the first embodiment are designated by the same reference numerals and detailed explanation thereof will be omitted.

In FIGS. 8 and 9, an endless mesh filter belt 50 is mounted around a drive roller 51 and a driven roller 52. The drive roller 51 is rotated in a direction shown by the arrow e by means of a drive motor 53. As the drive roller 51 is rotated, a lower run portion of the filter 50 is shifted in a direction shown by the arrow f and an upper run of the filter is shifted in a direction shown by the arrow g. The position of the filter 50 is regulated by holder rollers 54. Incidentally, the reference numeral 55 denotes seal members for preventing the toner from leaking.

Figure 10:
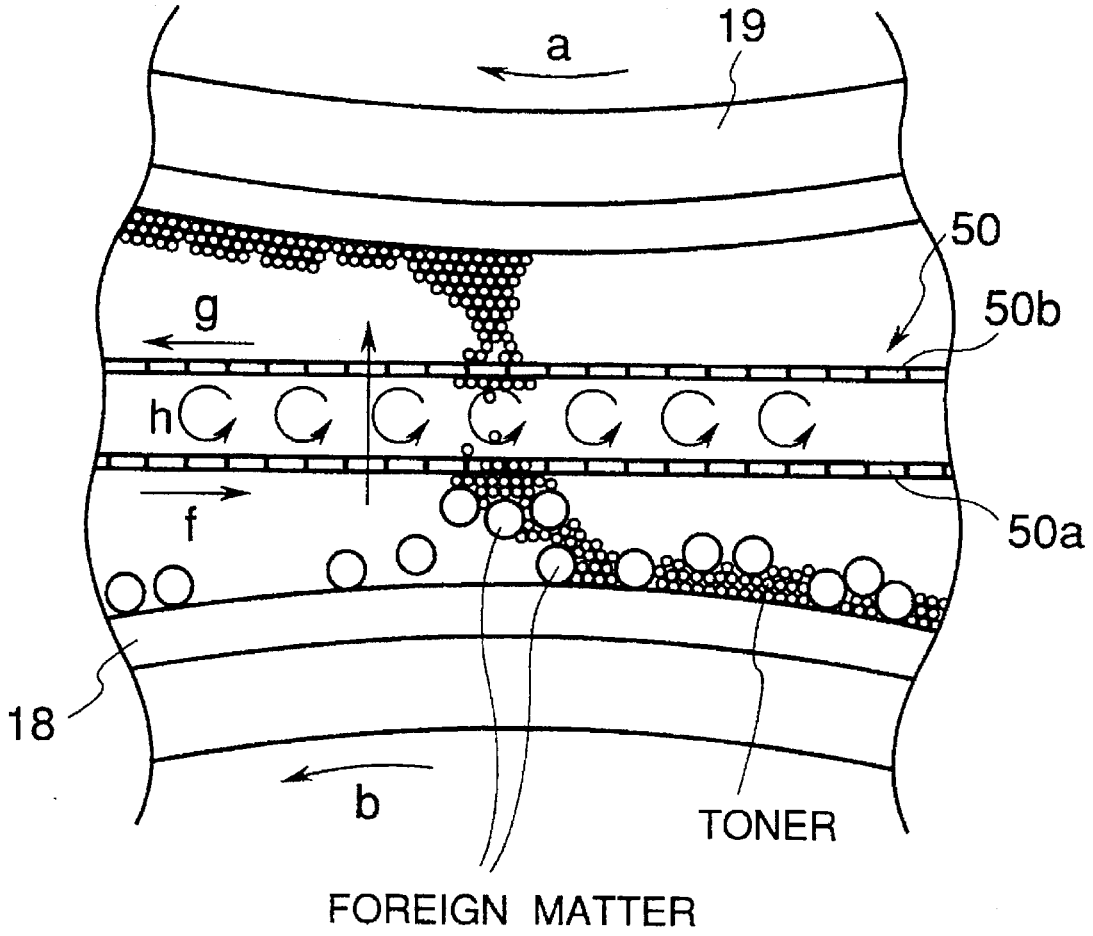
FIG. 10 is an explanatory view for explaining an operation of a mesh filter of the separating apparatus of FIG. 8.

With this arrangement, the upper and lower runs of the filter are shifted in opposite directions along the horizontal direction. In this case, when the separating apparatus 17 is operated, the movement of the toner particles is shown in FIG. 10. The toner from which the non-magnetic matter was removed by the lower run 50*a* of the filter 50 passes through the mesh in the upper run 50*b* of the filter 50 to reach the sleeve 19. In this case, since the lower run 50*a* is shifted in the direction f and the upper run 50*b* is shifted in the direction g, the toner particles retained between the upper and lower runs are rotated in directions shown by the arrows h. As a result, the toner retained between the upper and lower runs is adequately agitated and vibrated. Accordingly, the foreign matter can effectively be separated from the magnetic toner without generating noise. In addition, aggregation of the toner particles can be prevented.

The non-magnetic matter M such as paper powder separated from the magnetic toner by the separating apparatus 17 is collected in the collecting portion 29. However, there is a danger of overflowing the nonmagnetic matter from the collecting portion if an amount of the non-magnetic matter greater than a predetermined amount is accumulated in the collecting portion 29. To avoid this, in an embodiment shown in FIG. 11, a full amount detection sensor is provided in association with the collecting portion 29.

Figure 11:
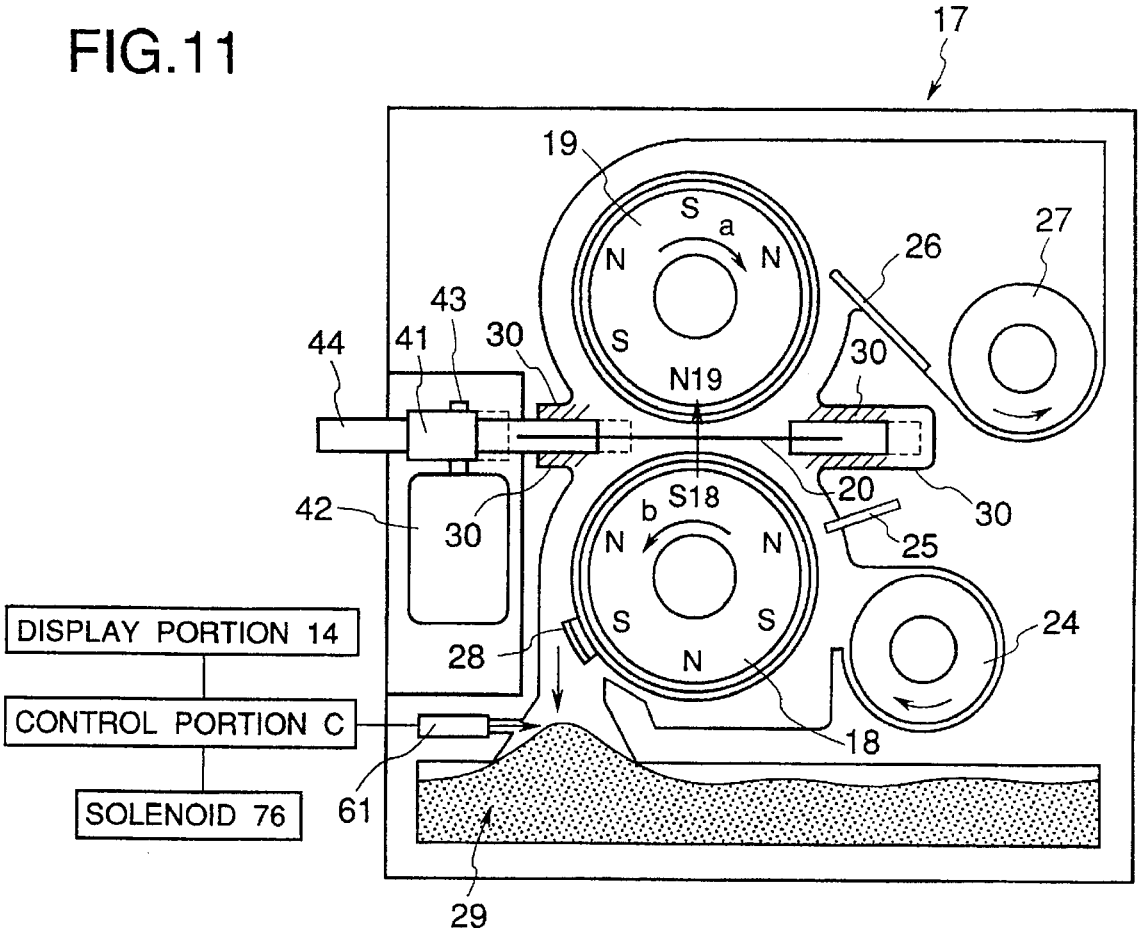
FIG. 11 is an elevational sectional view of a separating apparatus according to the other embodiment of the present invention.

Now, this embodiment will be explained with reference to FIG. 11. Since the construction of the separating apparatus according to this embodiment is the same as that of the first embodiment, explanation thereof will be omitted. In the separating apparatus 17, there is provided a full amount detection sensor 61 disposed in the proximity of an inlet of the collecting portion 29. When the fact that the collecting portion 29 is filled with the non-magnetic matter M (i.e., the fact that the amount of the non-magnetic matter collected in the collecting portion 29 reaches the predetermined amount) is detected by the full amount detection sensor 61, a signal from the sensor is input to a control portion C, thereby stopping the entire operation of the image forming apparatus. Accordingly, the non-magnetic matter M can be prevented from overflowing from the collecting portion 29.

This embodiment can be further improved so that when the condition that the collecting portion 29 is filled with the non-magnetic matter M is detected by the full amount detection sensor 61, such a condition can be displayed on a display 14 in response to a signal from the control portion C without stopping the entire operation of the image forming apparatus. With this arrangement, the operator can recognize the fact that the collecting portion 29 is filled with the nonmagnetic matter M. Further, even if the operator desires to utilize the image forming apparatus promptly, prompt usage of the image forming apparatus is permitted.

Figure 12:
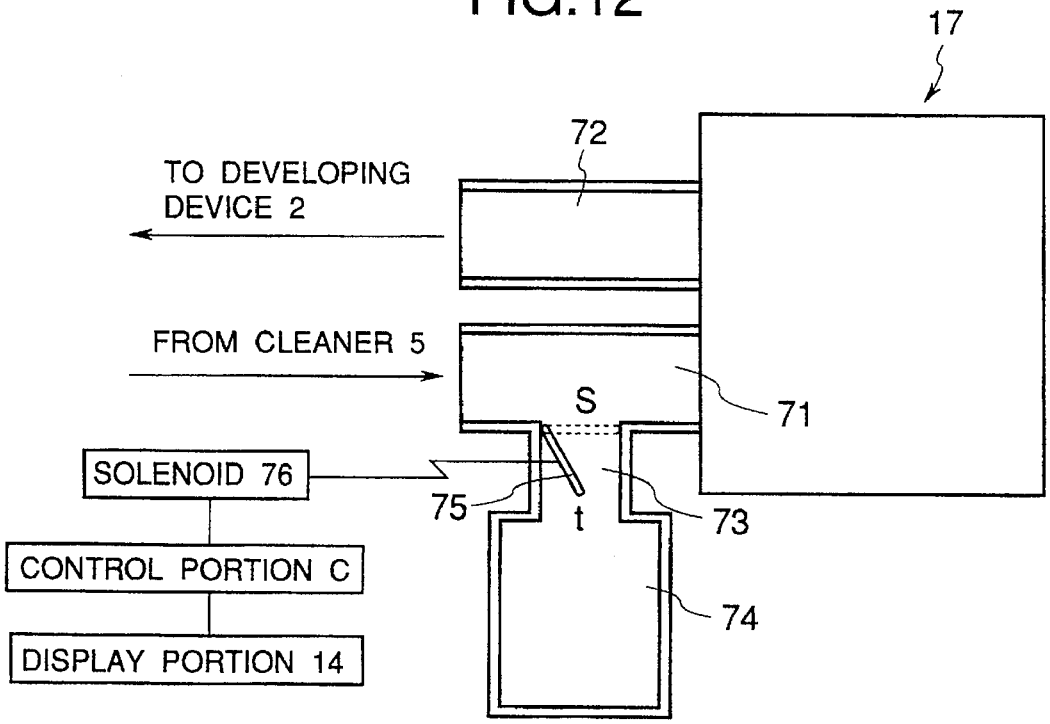
FIG. 12 is a side view of the separating apparatus of FIG. 11.

Next, a further embodiment of the present invention will be explained with reference to FIG. 12. Since the construction of the separating apparatus according to this embodiment is the same as that of the first embodiment, explanation thereof will be omitted. A first convey path 71 for conveying the toner (including the foreign matter) collected in the cleaning device 5 to the separating apparatus 17 and a discharge convey path 72 for returning the toner from which the foreign matter was removed to the developing device 2 are connected to the separating apparatus 17. A second convey path 73 is branched from the first convey path 71 to convey the toner to a collecting container 74. A switching means 75 is disposed between the first and second convey paths 71, 73 to selectively switch the convey paths. The switching means 75 is driven by a solenoid 76 to assume a position S where the first convey path 71 is selected or a position t where the second convey path 73 is selected.

Explaining the operation of the separating apparatus according to this embodiment in a normal operating condition, the solenoid 76 is in an OFF condition so that the switching means 75 is positioned at the position S. Accordingly, the collected toner sent from the cleaning device 5 is conveyed through the first convey path 71 to the separating apparatus 17, where the non-magnetic matter is separated from the toner by the aforementioned separating mechanism. The toner from which the foreign matter was removed is returned to the developing device 2 through the discharge convey path 72 and the non-magnetic matter is collected in the collecting portion 29.

On the other hand, when the fact that the collecting portion 29 is filled with the non-magnetic matter M is detected by the full amount detection sensor 61, the solenoid 76 is energized in response to the signal from the control portion C to position the switching means 75 at the position t, thereby selecting the second convey path 73. As a result, the toner (collected by the cleaning device) is collected into the collecting container 74 through the second convey path 73. At the same time, in response to the signal from the control portion C, the fact that the collecting portion 29 is filled with the non-magnetic matter M is displayed on the display 14 to inform the operator of such fact. Thus, the operator can remove the non-magnetic matter from the collecting portion 29. Further, during these operations, the image forming apparatus is maintained in an operative condition. With this arrangement, (1) since the image forming apparatus is not stopped, even in time of urgency, the image forming apparatus can be used; and (2) since the fact that the collecting portion 29 is filled with the non-magnetic matter is displayed, the operator can remove the non-magnetic matter from the collecting portion.

Now, an example of concrete values regarding the separating apparatus according to the aforementioned embodiments will be described. However, the present invention is not limited to such values.

First, the filter 20 is formed as a stainless steel mesh filter, and each opening thereof has a dimension of about 75 μm (#200). Further, a length of the filter 20 (along the direction X in FIG. 2) is about 70 mm, a width of the filter (along the direction Y in FIG. 2) is about 40 mm, and a thickness of the filter is about 0.1 mm.

Further, the sleeves 18, 19 are made of aluminum and each has an outer diameter of about 20 mm. An outer diameter of each of the magnets 18*a*, 19*a* incorporated into the sleeves 18, 19 is 17.6 mm, and a distance between the sleeves 18 and 19 is about 3 mm. Furthermore, the $S_{18}$ pole has about 650 gauss and $N_{19}$ pole has about 1000 gauss. From the view point of developing ability and image quality, it is preferable that a weight average particle diameter ($D_4$) of the toner is 3 to 12 μm (preferably, 3 to 10 μm, and, more preferably, 3 to 8 μm).

Although the grain size distribution of the toner can be measured by various methods, in the present invention, it was measured by using a Coaltar counter.

For example, a Coaltar counter TA-II (manufactured by Coaltar Co.) was used as a measuring device, and interfaces (manufactured by Nikkaki Co. in Japan) for outputting number distribution and volume distribution and a personal computer CX-1 (manufactured by Canon Co. in Japan) were connected to the measuring device. Aqueous solution including NaCl of 1% prepared by using first class sodium chloride was used as an electrolyte. In the measurement, a surface-active agent (preferably, alkyl benzene sulfonate) of 0.1 to 5 ml was added to the electrolytic solution of 100 to 150 ml as dispersing agent, and sample to be measured of 2 to 20 mg was also added to the electrolytic solution. The electrolytic solution including the sample suspension was subjected to the dispersing treatment for about 1 to 3 minutes by using a supersonic dispersing device. Thereafter, the volume of the toner and the number of toner particles were measured by the Coaltar counter TA-II using an aperture of 100 μm, thereby calculating the volume distribution and number distribution of toner particles of 2 to 40 μm. Thereafter, regarding the present invention, the weight average diameter (central value of each channel is used as a representative value of each channel) of weight reference sought from the volume distribution and standard deviation thereof, and a length average diameter of number reference sought from the number distribution and standard deviation thereof were determined.

In the aforementioned embodiments, the separating apparatus 17 (including the drive mechanism for driving the motor 42) is operated when the copy start button (not shown) of the image forming apparatus is depressed, and is stopped when the copying operation is finished.

As mentioned above, according to the above-mentioned embodiments, by setting the magnetic field so that the conveying force due to the magnetic force becomes sufficiently greater than the weight of the magnetic toner itself, it is possible to move the magnetic toner. In this way, in the above-mentioned embodiments, since the foreign matter is separated from the toner by moving the mixture from below to above in opposition to the gravity force, the non-magnetic matter (foreign matter) separated from the magnetic toner is prevented from passing through the filter 20 by the under-surface of the filter. Therefore, since the force for conveying the non-magnetic matter toward the sleeve 19 is ceased, the non-magnetic matter is dropped onto the sleeve 18 by its own weight. Further, in the above-mentioned embodiments, as mentioned above, the non-magnetic matter is forcibly separated from the filter 20 by the vibration applied to the filter 20. Thus, the foreign matter can be separated from the magnetic toner efficiently, and the filter 20 can be continuously prevented from clogging.

Further, the magnetic toner adhered to the surface of the sleeve 19 is conveyed downstream by the rotation of the sleeve 19 and is scraped from the surface of the sleeve by the scraper blade 26. The scraped toner is discharged out of the separating apparatus 17 by the convey screw 27. The re-generated magnetic toner (excluding the foreign matter) is conveyed to the developing device 2 (including the hopper portion 3) by means of a conveying device (not shown) for re-use.

Incidentally, the foreign matter separated from the toner at the separating zone X is regulated by the filter 20 and is dropped onto the sleeve 18, with the result that the dropped foreign matter is conveyed together with the toner remaining on the sleeve 18 by the rotation of the sleeve 18, and is separated from the surface of the sleeve 18 by the non-magnetic abutment member 28. The non-magnetic abutment member 28 is abutted against the sleeve 18 with light pressure. Thus, the foreign matter adhered to the surface of the sleeve 18 with a weak force can be scraped from the sleeve. However, since the lump of the magnetic toner (not separated at the separating zone X and) remaining on the sleeve 18 is adhered to the surface of the sleeve 18 with a strong force, it is not scraped from the sleeve by the non-magnetic abutment member 28, but is further conveyed downstream to be separated again. By repeating a series of the above-mentioned operations, the lump of the magnetic toner is gradually decomposed to be conveyed toward the sleeve 19. Thus, since most of the magnetic toner is not collected in the collecting portion 29, almost all of the matter collected in the collecting portion 29 consists of the foreign matter such as non-magnetic matter.

As mentioned above, by decomposing the lump of the magnetic toner and by dropping the foreign matter from the filter 20 in the gravity acting direction, the clogging of the filter 20 is prevented so that the foreign matter can be separated from the magnetic toner continuously and efficiently.

As mentioned above, according to the present invention, the foreign matter can effectively be separated from the toner. Further, no noise is generated, and a good foreign matter separating operation can always be performed stably. Furthermore, by applying the separating apparatus to the image forming apparatus, a good image can be obtained while greatly decreasing the toner consumption.

What is claimed is:

1. A separating apparatus for separating a foreign matter from magnetic toner, comprising:

a filter having openings allowing a magnetic toner to pass therethrough;

a vibration generating means for vibrating said filter in a substantially horizontal direction relative to a filter surface of said filter such that the magnetic toner moves in the substantially horizontal direction with the filter; and a magnetic field generating means for generating a magnetic field for attracting the magnetic toner through said filter in a direction in opposition to the pull of gravity when said filter is vibrating in the substantially horizontal direction.

2. A separating apparatus according to claim 1, wherein said vibration generating means comprises an eccentric cam for vibrating a support member supporting said filter to vibrate said filter in a substantially horizontal direction relative to said filter surface of said filter.

3. A separating apparatus according to claim 1, wherein the magnetic toner is a magnetic toner removed from an electrophotographic photosensitive member, said magnetic toner being adhered to a peripheral surface of a first roller incorporating a first magnet therein to be conveyed to a position opposing to said filter, and then, said magnetic toner being passed through said filter to be attracted toward and adhered to a peripheral surface of a second roller disposed above said filter and incorporating therein a second magnet acting as said magnetic field generating means for generating a magnetic force greater than that of said first magnet.

4. A separating apparatus according to claim 3, wherein a scraper is abutted against the peripheral surface of said second roller to scrape the magnetic toner adhered to the peripheral surface of said second roller.

5. A separating apparatus according to claim 3 or 4, wherein said first roller and said second roller are rotated in opposite directions.

6. A separating apparatus according to claim 1, further comprising a containing portion for containing foreign matter separated from the magnetic toner, and a detection means for detecting whether amount of the foreign matter contained in said containing portion reaches a predetermined amount or not.

7. A separating apparatus according to claim 6, wherein an operation of an image forming apparatus is stopped in response to a signal from said detection means.

8. A separating apparatus according to claim 6, wherein the fact that the amount of the foreign matter contained in said containing portion reaches the predetermined amount is displayed on a display, in response to a signal from said detection means.

9. A separating apparatus according to claim 1, wherein said vibration generating means vibrates said filter in the substantially horizontal direction relative to the filter surface thereof, with an amplitude in the order of about 1.0 mm to 5.0 mm.

10. A separating apparatus according to claim 1, wherein each of said openings of said filter has a dimension of about 37.5 to 150.0 μm.

11. A separating apparatus according to claim 7, wherein said filter is made of stainless steel.

12. A separating apparatus according to claim 1, wherein the magnetic toner is one-component magnetic toner and has an average particle diameter of about 3.0 to 12.0 μm.

13. A separating apparatus according to claim 5, further comprising a containing portion for containing foreign matter separated from the magnetic toner, and a detection means for detecting whether amount of the foreign matter contained in said containing portion reaches a predetermined amount or not.

14. A separating apparatus according to claim 13, wherein an operation of an image forming apparatus is stopped in response to a signal from said detection means.

15. A separating apparatus according to claim 13, wherein the fact that the amount of the foreign matter contained in said containing portion reaches the predetermined amount is displayed on a display, in response to a signal from said detection means.

16. A separating apparatus according to claim 5, wherein said vibration generating means vibrates said filter in the substantially horizontal direction relative to the filter surface thereof, with an amplitude in the order of about 1.0 mm to 5.0 mm.

17. A separating apparatus according to claim 6, wherein each of said openings of said filter has a dimension of about 37.5 to 150.0 μm.

18. A separating apparatus according to claim 13, wherein each of said openings of said filter has a dimension of about 37.5 to 150.0 μm.

19. A separating apparatus according to claim 14, wherein said filter is made of stainless steel.

20. A separating apparatus according to claim 6, wherein the magnetic toner is one-component magnetic toner and has an average particle diameter of about 3.0 to 12.0 μm.

21. A separating apparatus according to claim 13, wherein the magnetic toner is one-component magnetic toner and has an average particle diameter of about 3.0 to 12.0 μm.

22. A separating apparatus according to claim 10, wherein the magnetic toner is one-component magnetic toner and has an average particle diameter of about 3.0 to 12.0 μm.

23. A separating apparatus according to claim 17, wherein the magnetic toner is one-component magnetic toner and has an average particle diameter of about 3.0 to 12.0 μm.

24. A separating apparatus according to claim 18, wherein the magnetic toner is one-component magnetic toner and has an average particle diameter of about 3.0 to 12.0 μm.

25. A separating apparatus according to claim 16, wherein each of said openings of said filter has a dimension of about 37.5 to 150.0 μm.

26. An image forming apparatus for forming an image on a recording medium, comprising:

(a) an image bearing member, (b) an image forming means for forming a toner image on said image bearing member;

(c) a transfer means for transferring the toner image formed on said image bearing member by said image forming means onto the recording medium;

(d) a cleaning means for removing a residual matter adhered to said image bearing member, after the toner image was transferred by said transfer means;

(e) a separating means for separating the residual matter removed from said image bearing member by said cleaning means into foreign matter and magnetic toner, said separating means comprising a filter having openings for allowing a magnetic toner to pass therethrough, a vibration generating means for vibrating said filter in the substantially horizontal direction relative to a filter surface thereof such that the magnetic toner moves in the substantially horizontal direction with the filter, and a magnetic field generating means for generating a magnetic field for attracting the magnetic toner through said filter in a direction in opposition to the pull of gravity when said filter is vibrating in the substantially horizontal direction; and (f) a convey means for conveying the recording medium.

27. An image forming apparatus according to claim 26, wherein said vibration generating means comprises an eccentric cam for vibrating a support member supporting said filter to vibrate said filter in a substantially horizontal direction relative to said filter surface of said filter.

28. An image forming apparatus according to claim 26, wherein the magnetic toner is a magnetic toner removed from an electrophotographic photosensitive member, said magnetic toner being adhered to a peripheral surface of a first roller incorporating a first magnet therein to be conveyed to a position opposing to said filter, and then, said magnetic toner being passed through said filter to be attracted toward and adhered to a peripheral surface of a second roller disposed above said filter and incorporating therein a second magnet acting as said magnetic field generating means for generating a magnetic force greater than that of said first magnet.

29. An image forming apparatus according to claim 28, wherein a scraper is abutted against the peripheral surface of said second roller to scrape the magnetic toner adhered to the peripheral surface of said second roller.

30. An image forming apparatus according to claim 28 or 29, wherein said first and second rollers are rotated in opposite directions.

31. An image forming apparatus according to claim 26, further comprising a containing portion for containing foreign matter separated from the magnetic toner, and a detection means for detecting whether an amount of the foreign matter contained in said containing portion reaches a predetermined amount or not.

32. An image forming apparatus according to claim 31, wherein an operation of the image forming apparatus is stopped in response to a signal from said detection means.

33. An image forming apparatus according to claim 31, wherein the fact that the amount of the foreign matter contained in said containing portion reaches the predetermined amount is displayed on a display, in response to a signal from said detection means.

34. An image forming apparatus according to claim 26, wherein said vibration generating means vibrates said filter in a substantially horizontal direction relative to the filter surface thereof, with an amplitude in the order of about 1.0 mm to 5.0 mm.

35. An image forming apparatus according to claim 26, wherein each of said openings of said filter has a dimension of about 37.5 to 150.0 μm.

36. An image forming apparatus according to claim 32, wherein said filter is made of stainless steel.

37. An image forming apparatus according to claim 26, wherein the magnetic toner is one-component magnetic toner and has an average particle diameter of about 3.0 to 12.0 μm.

38. An image forming apparatus according to claim 30, further comprising a containing portion for containing foreign matter separated from the magnetic toner, and a detection means for detecting whether an amount of the foreign matter contained in said containing portion reaches a predetermined amount or not.

39. An image forming apparatus according to claim 38, wherein an operation of the image forming apparatus is stopped in response to a signal from said detection means.

40. An image forming apparatus according to claim 38, wherein the fact that the amount of the foreign matter contained in said containing portion reaches the predetermined amount is displayed on a display, in response to a signal from said detection means.

41. An image forming apparatus according to claim 30, wherein said vibration generating means vibrates said filter in a substantially horizontal direction relative to the filter surface thereof, with an amplitude in the order of about 1.0 mm to 5.0 mm.

42. An image forming apparatus according to claim 31, wherein each of said openings of said filter has a dimension of about 37.5 to 150.0 μm.

43. An image forming apparatus according to claim 31, wherein the magnetic toner is one-component magnetic toner and has an average particle diameter of about 3.0 to 12.0 μm.

44. An image forming apparatus according to claim 35, wherein the magnetic toner is one-component magnetic toner and has an average particle diameter of about 3.0 to 12.0 μm.

* * * * *

UNITED STATES PATENT AND TRADEMARK OFFICE

CERTIFICATE OF CORRECTION

PATENT NO. : 5,628,406

DATED : May 13, 1997

INVENTOR(S) : YASUMI YOSHIDA, ET AL.

It is certified that error appears in the above-indentified patent and that said Letters Patent is hereby corrected as shown below:

COLUMN 1:

Line 50, "the" (first occurrence) should be deleted; and "matters" should read --matter--.

Line 51, "and," should read --and--.

Line 52, "the" should be deleted.

UNITED STATES PATENT AND TRADEMARK OFFICE

CERTIFICATE OF CORRECTION

PATENT NO. : 5,628,406 Page 2 of 2

DATED : May 13, 1997

INVENTOR(S) : YASUMI YOSHIDA, ET AL.

It is certified that error appears in the above-indentified patent and that said Letters Patent is hereby corrected as shown below:

COLUMN 3:

Line 48, "where at" should read --whereat--.
Line 49, "which" should be deleted.

COLUMN 4:

Lines 11-12, "when" should read --in relation to--.

COLUMN 9:

Line 52, "as" should read --as a--; and "and" should read --and a--.

Signed and Sealed this

Twenty-eighth Day of October, 1997

*Attest:*

Bruce Lehman

BRUCE LEHMAN

*Attesting Officer*

*Commissioner of Patents and Trademarks*